US010036987B2

(12) United States Patent
Nanno et al.

(10) Patent No.: US 10,036,987 B2
(45) Date of Patent: Jul. 31, 2018

(54) REMOVABLE FIXING DEVICE HAVING A CONVEX GUIDE AND IMAGE FORMING APPARATUS

(71) Applicants: Shigeo Nanno, Kanagawa (JP); Toshio Ogiso, Tokyo (JP); Masahiro Samei, Kanagawa (JP); Tamotsu Ikeda, Tokyo (JP)

(72) Inventors: Shigeo Nanno, Kanagawa (JP); Toshio Ogiso, Tokyo (JP); Masahiro Samei, Kanagawa (JP); Tamotsu Ikeda, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/675,827

(22) Filed: Aug. 14, 2017

(65) Prior Publication Data

US 2018/0067431 A1 Mar. 8, 2018

(30) Foreign Application Priority Data

Sep. 6, 2016 (JP) ..... 2016-173629

(51) Int. Cl.
*G03G 15/20* (2006.01)

(52) U.S. Cl.
CPC ..... *G03G 15/2085* (2013.01); *G03G 15/2053* (2013.01); *G03G 15/2067* (2013.01); *G03G 2215/2035* (2013.01)

(58) Field of Classification Search
CPC ..... G03G 15/2017; G03G 15/2032; G03G 15/2035; G03G 15/2053; G03G 21/1685
USPC ..... 399/122
See application file for complete search history.

(56) References Cited

U.S. PATENT DOCUMENTS

| | | | | |
|---|---|---|---|---|
| 8,364,061 | B2 * | 1/2013 | Nanno | G03G 21/1685 399/122 |
| 8,571,442 | B2 * | 10/2013 | Sato et al. | G03G 21/1685 399/122 |
| 2009/0010680 | A1 | 1/2009 | Nanno | |
| 2009/0060572 | A1 | 3/2009 | Naitoh et al. | |
| 2009/0074440 | A1 | 3/2009 | Nanno et al. | |
| 2009/0129836 | A1 | 5/2009 | Sakaya et al. | |
| 2012/0002997 | A1 | 1/2012 | Hiraoka et al. | |
| 2012/0007307 | A1 | 1/2012 | Nanno et al. | |
| 2013/0004192 | A1 | 1/2013 | Kawakami et al. | |
| 2014/0153965 | A1 | 6/2014 | Nanno | |

FOREIGN PATENT DOCUMENTS

| | | |
|---|---|---|
| JP | 2012-133400 | 7/2012 |
| JP | 2014-224992 | 12/2014 |
| JP | 2015-191116 | 11/2015 |

* cited by examiner

*Primary Examiner* — William J Royer
(74) *Attorney, Agent, or Firm* — Oblon, McClelland, Maier & Neustadt, L.L.P.

(57) ABSTRACT

A fixing device is removably installed inside an apparatus body including an apparatus guide. The fixing device includes a convex guide guided along the apparatus guide and a heater to heat a recording medium to fix a toner image on the recording medium. The heater includes a lateral end in a longitudinal direction of the heater. The lateral end is disposed inside the convex guide.

14 Claims, 11 Drawing Sheets

REMOVABLE FIXING DEVICE HAVING A CONVEX GUIDE AND IMAGE FORMING APPARATUS

CROSS-REFERENCE TO RELATED APPLICATION

This patent application is based on and claims priority pursuant to 35 U.S.C. § 119 to Japanese Patent Application No. 2016-173629, filed on Sep. 6, 2016, in the Japanese Patent Office, the entire disclosure of which is hereby incorporated by reference herein.

BACKGROUND

Technical Field

Exemplary aspects of the present disclosure relate to a fixing device and an image forming apparatus, and more particularly, to a fixing device for fixing a toner image on a recording medium and an image forming apparatus incorporating the fixing device.

Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and an opposed rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the opposed rotator apply heat and pressure to the recording medium, melting and fixing the toner image on the recording medium.

SUMMARY

This specification describes below an improved fixing device. In one embodiment, the fixing device is removably installed inside an apparatus body including an apparatus guide. The fixing device includes a convex guide guided along the apparatus guide and a heater to heat a recording medium to fix a toner image on the recording medium. The heater includes a lateral end in a longitudinal direction of the heater. The lateral end is disposed inside the convex guide.

This specification further describes an improved image forming apparatus. In one embodiment, the image forming apparatus includes an apparatus body including an apparatus guide and a fixing device removably installed inside the apparatus body. The fixing device includes a convex guide guided along the apparatus guide and a heater to heat a recording medium to fix a toner image on the recording medium. The heater includes a lateral end in a longitudinal direction of the heater. The lateral end is disposed inside the convex guide.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
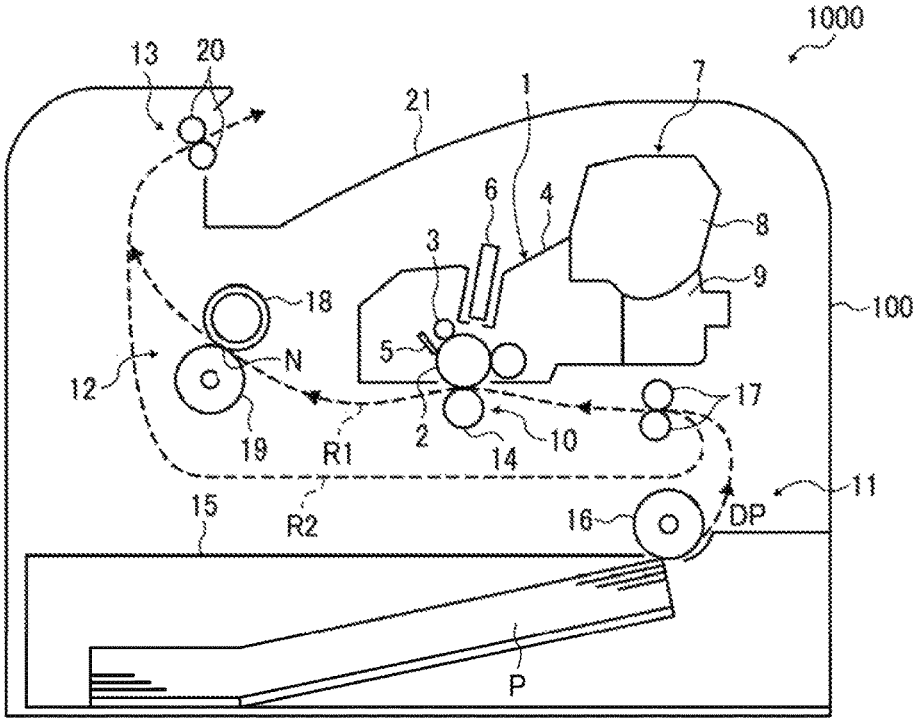
FIG. 1 is a schematic vertical cross-sectional view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION OF THE DISCLOSURE

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring now to the drawings, wherein like reference numerals designate identical or corresponding parts throughout the several views, particularly to FIG. 1, an image forming apparatus 1000 according to an embodiment is explained.

FIG. 1 is a schematic vertical cross-sectional view of the image forming apparatus 1000. The image forming apparatus 1000 may be a copier, a facsimile machine, a printer, a multifunction peripheral or a multifunction printer (MFP) having at least one of copying, printing, scanning, facsimile, and plotter functions, or the like. According to this embodiment, the image forming apparatus 1000 is a monochrome printer that forms a monochrome toner image on a recording medium by electrophotography. Alternatively, the image forming apparatus 1000 may be a color printer that forms a color toner image on a recording medium.

Referring to FIG. 1, a description is provided of a construction of the image forming apparatus 1000.

In the drawings for explaining embodiments of this disclosure, identical reference numerals are assigned as long as discrimination is possible to components such as members and component parts having an identical function or shape, thus omitting description thereof once it is provided.

The image forming apparatus 1000 depicted in FIG. 1 is a monochrome image forming apparatus for forming a monochrome toner image on a recording medium by electrophotography. The image forming apparatus 1000 includes an apparatus body 100 in which a process unit 1 serving as an image forming unit or an image forming device is removably installed. The process unit 1 includes a photoconductor 2, a charging roller 3, a developing device 4, and a cleaning blade 5. The photoconductor 2 serves as an image bearer or a latent image bearer that bears an electrostatic latent image and a resultant toner image on an outer circumferential surface of the photoconductor 2. The charging roller 3 serving as a charger charges the outer circumferential surface of the photoconductor 2. The developing device 4 visualizes the electrostatic latent image on the photoconductor 2 as the toner image. The cleaning blade 5 serving as a cleaner cleans the outer circumferential surface of the photoconductor 2. A light-emitting diode (LED) head array 6 serving as an exposure device that exposes the outer circumferential surface of the photoconductor 2 is disposed opposite the photoconductor 2.

A toner cartridge 7 is detachably attached to the process unit 1. The toner cartridge 7 serves as a powder container that contains toner as powder used to form the toner image. The toner cartridge 7 includes a fresh toner container 8 that contains fresh toner before use and a waste toner container 9 that contains waste toner after use.

The image forming apparatus 1000 further includes a transfer device 10, a sheet feeder 11, a fixing device 12, a sheet ejector 13, and a registration roller pair 17. The transfer device 10 transfers the toner image formed on the photoconductor 2 onto a sheet P serving as a recording medium. The sheet feeder 11 supplies the sheet P to the transfer device 10. The fixing device 12 fixes the toner image transferred onto the sheet P thereon. The sheet ejector 13 ejects the sheet P onto an outside of the image forming apparatus 1000. The registration roller pair 17 serves as a timing roller pair.

A detailed description is now given of a construction of the transfer device 10.

The transfer device 10 includes a transfer roller 14 serving as a transferor. While the process unit 1 is installed in the apparatus body 100, the transfer roller 14 contacts the photoconductor 2. The transfer roller 14 is coupled to a power supply that applies at least one of a predetermined direct current (DC) voltage and a predetermined alternating current (AC) voltage thereto.

A detailed description is now given of a construction of the sheet feeder 11.

The sheet feeder 11 includes a paper tray 15 that loads a plurality of sheets P and a feed roller 16 that feeds an uppermost sheet P of the plurality of sheets P loaded on the paper tray 15 toward the registration roller pair 17. The sheets P may be plain paper, thick paper, thin paper, postcards, envelopes, coated paper, art paper, tracing paper, and the like. Further, the sheets P may be overhead projector (OHP) transparencies (e.g., a sheet and film) and the like that are used as recording media.

A detailed description is now given of a construction of the fixing device 12.

The fixing device 12 (e.g., a fuser or a fusing unit) includes a fixing roller 18 and a pressure roller 19. The fixing roller 18 serves as a fixing rotator or a fixing member that fixes the toner image on the sheet P. The pressure roller 19 serves as an opposed rotator or an opposed member that is disposed opposite the fixing roller 18. A heater heats the fixing roller 18. The pressure roller 19 is pressed against the fixing roller 18 to form a fixing nip N between the fixing roller 18 and the pressure roller 19 contacting the fixing roller 18.

The sheet ejector 13 includes an ejection roller pair 20 that ejects the sheet P onto the outside of the image forming apparatus 1000. An output tray 21 is disposed on an upper outer cover of the apparatus body 100. The output tray 21 stocks the sheet P ejected by the ejection roller pair 20.

A conveyance path R1 is disposed inside the apparatus body 100. The sheet P is conveyed through the conveyance path R1 from the paper tray 15 to the ejection roller pair 20 through the registration roller pair 17, the transfer roller 14, a transfer nip formed between the photoconductor 2 and the transfer roller 14 where the toner image is transferred from the photoconductor 2 onto the sheet P, and the fixing device 12. A duplex conveyance path R2 is disposed inside the apparatus body 100. When the image forming apparatus 1000 performs duplex printing, the sheet P having passed through the fixing device 12 is conveyed through the duplex conveyance path R2 to the transfer nip again.

Referring to FIG. 1, a description is provided of an image formation performed by the image forming apparatus 1000 having the construction described above to form a toner image on a sheet P.

As an image formation starts, a driver drives and rotates the photoconductor 2. The charging roller 3 uniformly charges the outer circumferential surface of the photoconductor 2 at a predetermined polarity. The LED head array 6 exposes the charged outer circumferential surface of the photoconductor 2 according to image data sent from a scanner or an external device such as a client computer, thus forming an electrostatic latent image on the charged outer circumferential surface of the photoconductor 2. The developing device 4 supplies toner to the electrostatic latent image formed on the photoconductor 2, visualizing the electrostatic latent image as a toner image.

On the other hand, as the image formation starts, the feed roller 16 starts rotation to pick up and feed a sheet P from the paper tray 15 toward the registration roller pair 17. The registration roller pair 17 temporarily halts the sheet P conveyed through the conveyance path R1. Thereafter, the registration roller pair 17 resumes rotation at a predetermined time to convey the sheet P to the transfer nip at a time when the toner image formed on photoconductor 2 reaches the transfer nip.

As the sheet P is conveyed to the transfer nip, the transfer roller 14 applied with a predetermined voltage generates a transfer electric field that transfers the toner image formed on the photoconductor 2 onto the sheet P. After the transfer of the toner image from the photoconductor 2 onto the sheet P, the cleaning blade 5 removes residual toner failed to be transferred onto the sheet P and therefore remaining on the photoconductor 2 therefrom. The removed toner is collected into the waste toner container 9 of the toner cartridge 7.

The sheet P bearing the toner image is conveyed to the fixing device 12. As the sheet P is conveyed through the fixing nip N formed between the fixing roller 18 and the pressure roller 19, the toner image is fixed on the sheet P under heat and pressure. Thereafter, the sheet P bearing the toner image is ejected by the ejection roller pair 20 onto the outside of the image forming apparatus 1000, that is, the output tray 21 that stocks the sheet P.

If the image forming apparatus 1000 performs an image formation of duplex printing, the sheet P having passed through the fixing device 12 is not ejected onto the outside of the image forming apparatus 1000 and is switched back and sent to the duplex conveyance path R2. The sheet P is conveyed through the duplex conveyance path R2 and sent to the conveyance path R1 at an upstream position upstream from the registration roller pair 17 in a sheet conveyance direction DP. The registration roller pair 17 conveys the sheet P to the transfer nip again. The transfer roller 14 transfers another toner image onto a back side of the sheet P. The fixing device 12 fixes the toner image on the back side of the sheet P. Thereafter, the sheet P bearing the toner image is ejected onto the outside of the image forming apparatus 1000.

A description is provided of a construction of the fixing device 12 incorporated in the image forming apparatus 1000 having the construction described above.

Figure 2:
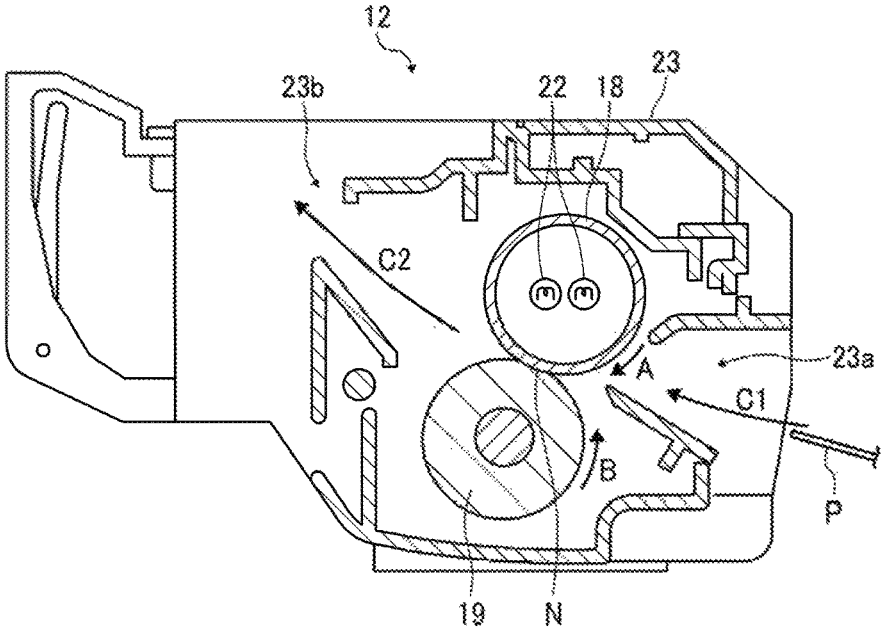
FIG. 2 is a schematic vertical cross-sectional view of a fixing device incorporated in the image forming apparatus depicted in FIG. 1.

FIG. 2 is a schematic vertical cross-sectional view of the fixing device 12. As illustrated in FIG. 2, the fixing device 12 includes a frame 23 being made of resin and serving as an exterior. The fixing roller 18 and the pressure roller 19 are disposed inside the frame 23. The frame 23 includes an inlet 23*a* situated at a front face of the frame 23. The sheet P enters the fixing device 12 through the inlet 23*a*. The frame 23 further includes an outlet 23*b* situated at a rear face of the frame 23. The sheet P exits from the fixing device 12 through the outlet 23*b*. A front face of the fixing device 12 is a front face of the image forming apparatus 1000 installed with the fixing device 12. A user faces the front face of the image forming apparatus 1000 to input a print instruction by using a control device (e.g., a control panel) of the image forming apparatus 1000. A halogen heater 22 serving as a heat generator is disposed inside the fixing roller 18. A pressurization assembly described below presses the pressure roller 19 against the fixing roller 18 to form the fixing nip N between the pressure roller 19 and the fixing roller 18 contacting the pressure roller 19.

Figure 3:
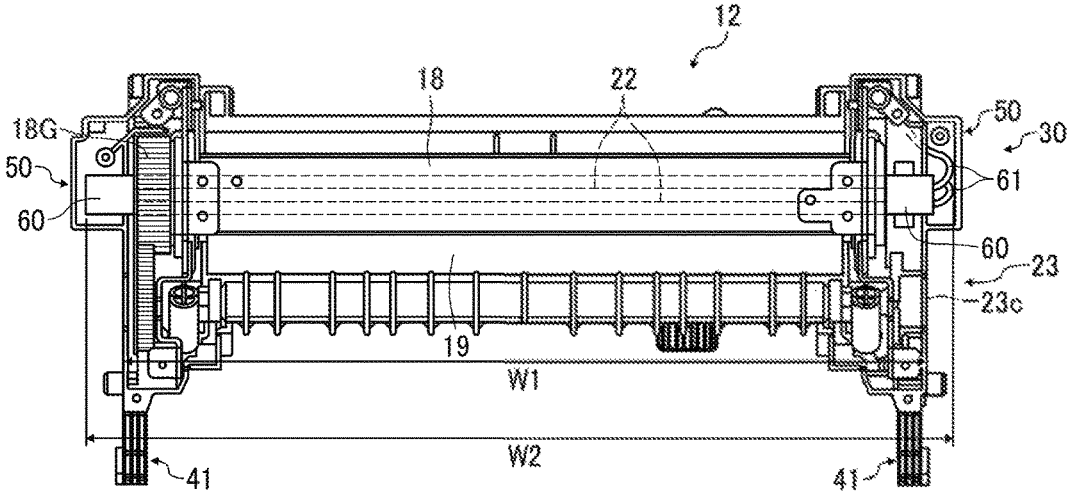
FIG. 3 is a plan view of the fixing device depicted in FIG. 2 from which an upper portion of an exterior of the fixing device is removed.

FIG. 3 is a plan view of the fixing device 12 from which an upper portion of the exterior of the fixing device 12 is removed. As illustrated in FIG. 3, a fixing gear 18G is mounted on one lateral end of the fixing roller 18 in an axial direction thereof. The fixing gear 18G is coupled to a driving gear disposed inside the apparatus body 100. Accordingly, in a state in which the fixing device 12 is installed in the apparatus body 100 and the fixing gear 18G is coupled to the driving gear, as a driving force generated by a driver disposed inside the apparatus body 100 is transmitted to the fixing roller 18, the fixing roller 18 is driven and rotated in a rotation direction A in FIG. 2. The pressure roller 19 is rotated in a rotation direction B in FIG. 2 in accordance with rotation of the fixing roller 18. As the fixing gear 18G drives and rotates the fixing roller 18 and the fixing roller 18 drives and rotates the pressure roller 19, the fixing roller 18 and the pressure roller 19 convey the sheet P while sandwiching the sheet P. Alternatively, unlike the fixing roller 18 and the pressure roller 19 according to this embodiment, the pressure roller 19 may be a driving roller that drives and rotates the fixing roller 18 and the fixing roller 18 may be a driven roller that is driven and rotated by the pressure roller 19.

Referring to FIG. 2, a brief description is provided of a fixing operation of the fixing device 12.

In a state in which the fixing roller 18 is heated by radiation heat radiated from the halogen heater 22 to a predetermined temperature and the fixing roller 18 and the pressure roller 19 rotate, when the sheet P enters the fixing nip N in a sheet conveyance direction C1, the sheet P is conveyed while the sheet P is sandwiched between the fixing roller 18 and the pressure roller 19. As an unfixed toner image on the sheet P is heated by the fixing roller 18 and pressed by the fixing roller 18 and the pressure roller 19, the toner image is fixed on the sheet P. The sheet P bearing the fixed toner image is ejected from the fixing nip N and conveyed in a sheet conveyance direction C2 in FIG. 2.

A description is provided of a detailed construction of the fixing device 12.

Figure 4:
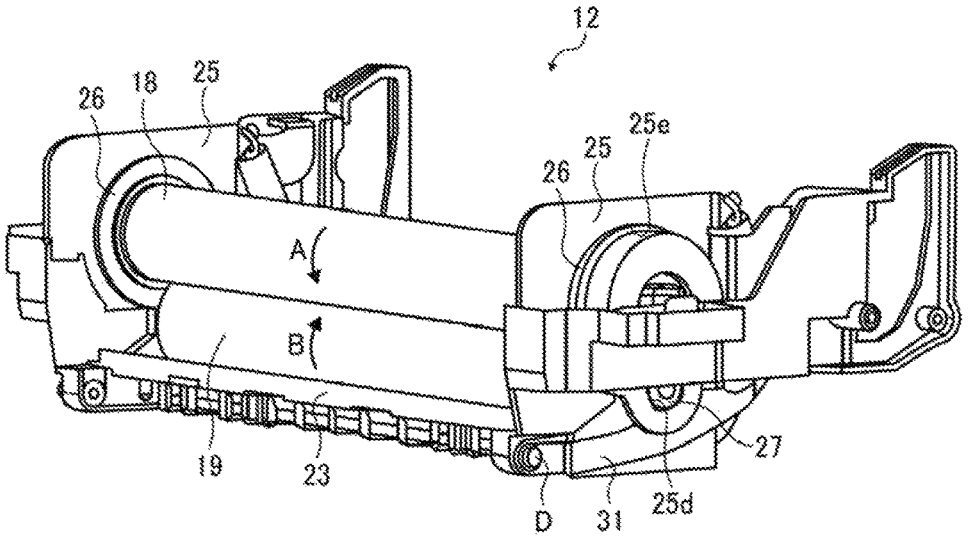
FIG. 4 is a perspective view of the fixing device depicted in FIG. 2 from which the upper portion of the exterior of the fixing device is removed.
Figure 5:
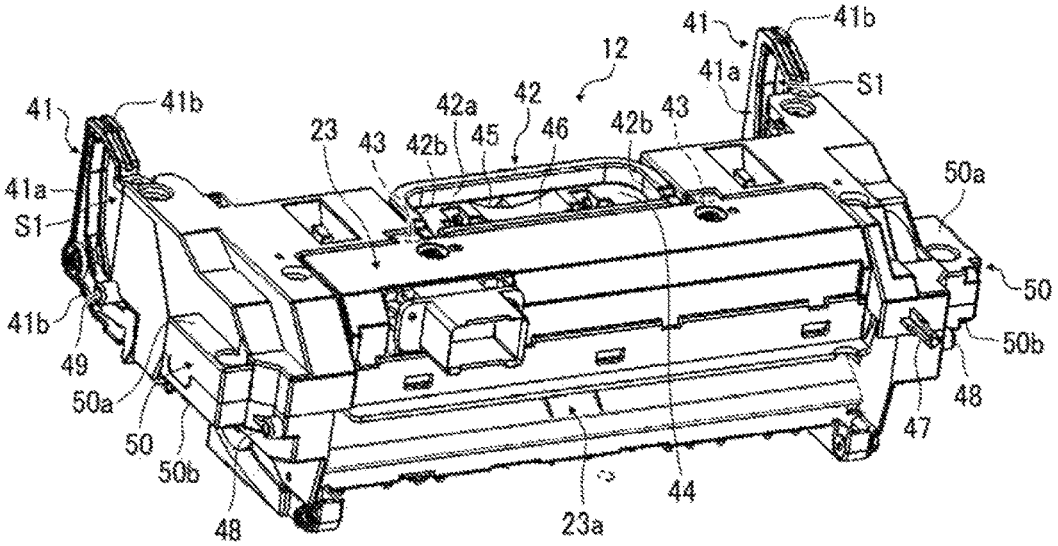
FIG. 5 is a perspective view of the fixing device depicted in FIG. 2, viewing a front of the fixing device from a position obliquely upward from the fixing device.
Figure 6:
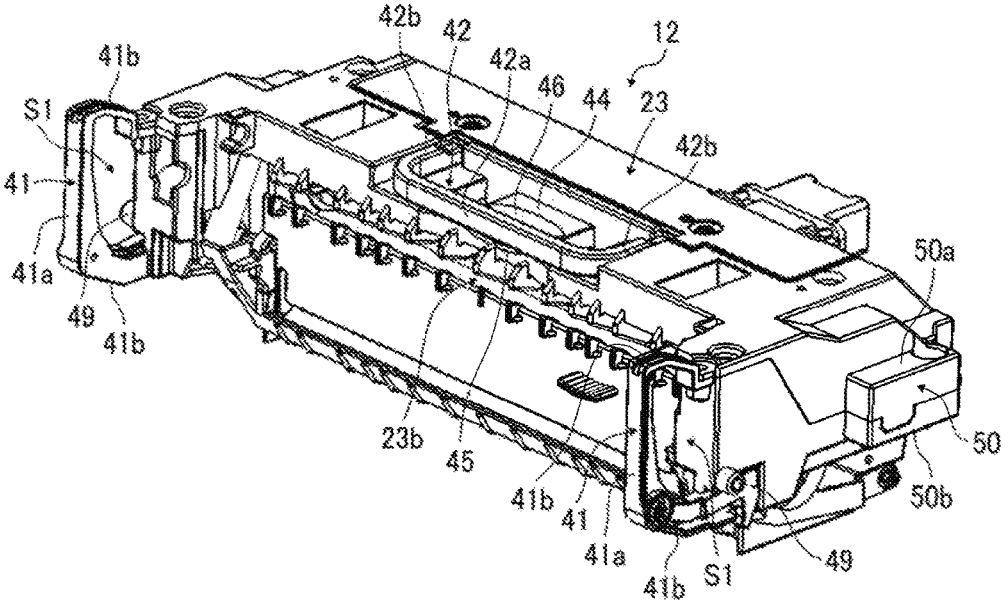
FIG. 6 is a perspective view of the fixing device depicted in FIG. 2, viewing a rear of the fixing device from a position obliquely upward from the fixing device.
Figure 7:
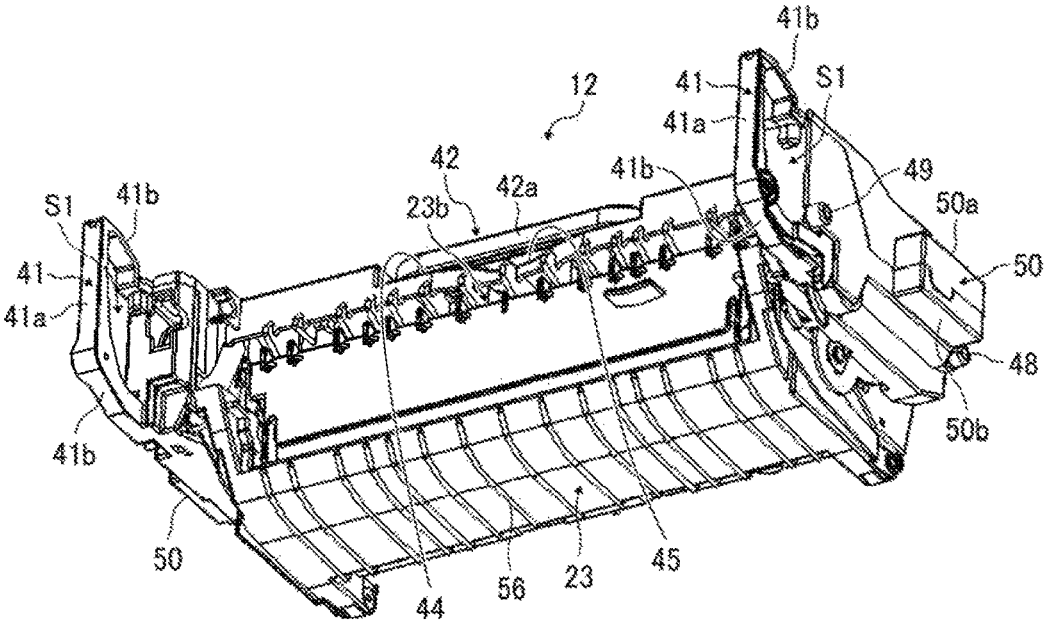
FIG. 7 is a perspective view of the fixing device depicted in FIG. 2, viewing the rear of the fixing device from a position obliquely downward from the fixing device.
Figure 8:
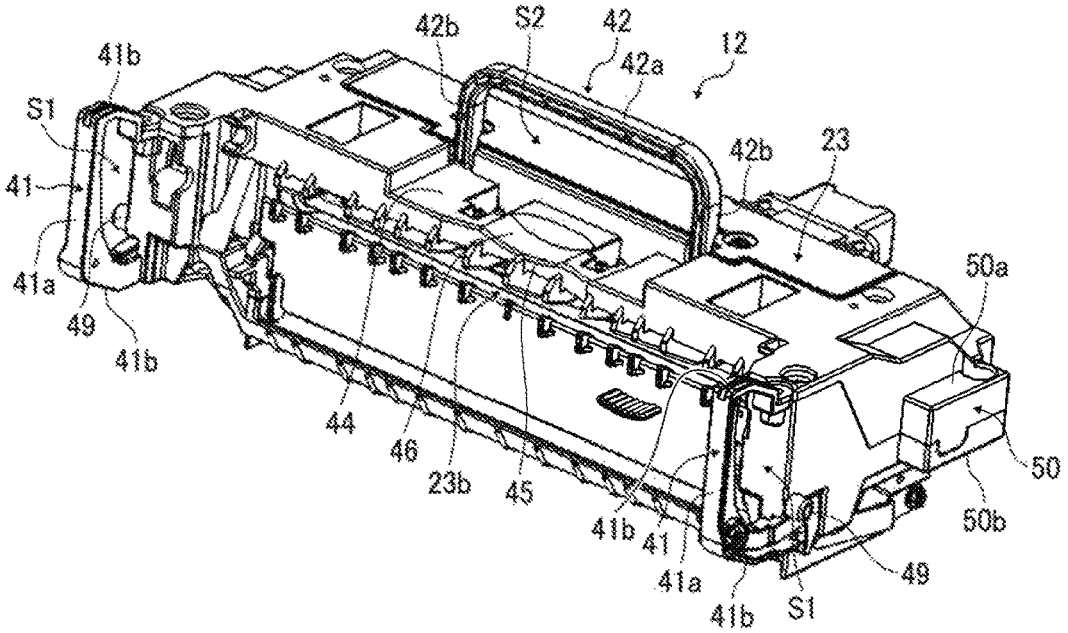
FIG. 8 is a perspective view of the fixing device depicted in FIG. 2, viewing the rear of the fixing device from a position obliquely upward from the fixing device.

FIG. 4 is a perspective view of the fixing device 12 from which the upper portion of the exterior of the fixing device 12 is removed. FIG. 5 is a perspective view of the fixing device 12, viewing a front of the fixing device 12 from a position obliquely upward from the fixing device 12. FIG. 6 is a perspective view of the fixing device 12, viewing a rear of the fixing device 12 from a position obliquely upward from the fixing device 12. FIG. 7 is a perspective view of the fixing device 12, viewing the rear of the fixing device 12 from a position obliquely downward from the fixing device 12. FIG. 8 is a perspective view of the fixing device 12, viewing the rear of the fixing device 12 from a position obliquely upward from the fixing device 12.

As illustrated in FIG. 4, a support 25 made of metal is mounted on each of one lateral end and another lateral end of the frame 23 in a longitudinal direction thereof. Bearings 26 and 27 mounted on each support 25 rotatably support the fixing roller 18 and the pressure roller 19, respectively. The bearing 26 that supports the fixing roller 18 is fitted into and secured to a bearing engagement 25*e* disposed in each support 25. The bearing engagement 25*e* is a circular hole. The bearing 27 that supports the pressure roller 19 is movably fitted into a bearing guide 25*d* disposed in each support 25. The bearing guide 25*d* is a rectangular hole. Since the bearing 27 supporting the pressure roller 19 is movable, the pressure roller 19 comes into contact with and separates from the fixing roller 18. A pressure lever 31 made of metal is attached to each of a lower portion of one lateral end of the frame 23 and a lower portion of another lateral end of the frame 23 in the longitudinal direction thereof. The pressure lever 31 serves as a presser that presses the pressure roller 19 against the fixing roller 18. As the pressure lever 31 pivots about a fulcrum D, the pressure lever 31 moves the pressure roller 19 relative to the fixing roller 18 in an approach direction and a direction opposite the approach direction. Accordingly, the pressure roller 19 switches between an approach position where the pressure roller 19 approaches the fixing roller 18 to press against the fixing roller 18 with normal pressure and a retracted position where the pressure roller 19 is retracted from the fixing roller 18 to press against the fixing roller 18 with decreased pressure smaller than the normal pressure.

As illustrated in FIGS. 5 to 8, the frame 23 is mounted with a pair of first grips 41 and a second grip 42 that are gripped by an operator (e.g., the user or a service engineer) who attaches and detaches the fixing device 12 with respect to the apparatus body 100. The first grip 41 is mounted on each lateral end of the rear face of the frame 23 in the longitudinal direction thereof. The second grip 42 is mounted on a center of an upper face of the frame 23 in the longitudinal direction thereof.

The first grips 41 are symmetrical with each other. For example, the first grip 41 includes a grip portion 41*a* and a pair of arms 41*b*. The grip portion 41*a* extends vertically in FIG. 5 in a direction perpendicular to the longitudinal direction of the frame 23. The arms 41*b* project from an upper end and a lower end of the grip portion 41*a* forward toward the front of the fixing device 12, respectively. The grip portion 41*a* is secured to the rear face of the frame 23 via the pair of arms 41*b*. A space S1 is provided between the grip portion 41*a* and the rear face of the frame 23. The operator inserts his or her hand or fingers into the space S1.

Conversely, the second grip 42 is pivotally attached to the frame 23. For example, the second grip 42 includes a grip portion 42*a* and a pair of arms 42*b*. The grip portion 42*a* extends horizontally in FIG. 5 in the longitudinal direction of the frame 23. The arms 42*b* project from the grip portion 42*a* in a direction perpendicular to or crossing an extension direction of the grip portion 42*a*. A tip of each of the arms 42*b* is attached to the frame 23 through a support shaft 43 such that the arm 42*b* is pivotable about the support shaft 43. As the second grip 42 pivots about the support shafts 43, the second grip 42 switches between a lying position illustrated in FIG. 6 and a standing position illustrated in FIG. 8. At the lying position illustrated in FIG. 6, the second grip 42 is placed inside a storage 44 (e.g., a recess) provided on the upper face of the frame 23. Conversely, at the standing position, that is, a usage position, illustrated in FIG. 8, the second grip 42 projects outward and upward relative to the second grip 42 at the lying position, that is, a storage position, depicted in FIG. 6, thus, allowing the operator to grip the second grip 42. For example, when the second grip 42 is at the standing position, a space S2 is provided between the grip portion 42*a* and the upper face of the frame 23 (e.g., the storage 44). The operator inserts his or her hand or fingers into the space S2 and grips the grip portion 42*a*.

The storage 44 is provided with two recesses, that is, a first recess 45 and a second recess 46, to help the fingers of the operator catch the second grip 42 when the operator moves the second grip 42 from the lying position (e.g., the storage position) to the standing position (e.g., the usage position). A center of a rear edge of the storage 44 in the longitudinal direction of the frame 23 is depressed forward into the first recess 45 as illustrated in FIG. 7. A center of an upper face of the storage 44 in the longitudinal direction of the frame 23 is depressed downward into the second recess 46 as illustrated in FIG. 8.

As illustrated in FIG. 5, a plurality of positioners, that is, a first positioning projection 47, a pair of second positioning projections 48, and a pair of third positioning projections 49, is mounted on the frame 23. The positioners position the fixing device 12 to the apparatus body 100. The first positioning projection 47 is mounted on one lateral end (e.g., a right end in FIG. 5) of the front face of the frame 23 in the longitudinal direction thereof. The second positioning projections 48 are mounted on front sides of side faces (e.g., a right face and a left face in FIG. 5), respectively, of the frame 23. The third positioning projections 49 are mounted on rear sides of the side faces (e.g., the right face and the left face in FIG. 5), respectively, of the frame 23.

Each of the side faces (e.g., the right face and the left face in FIG. 5) of the frame 23 mounts a guiding protrusion 50 serving as a convex guide that is guided along an apparatus body guide described below when the fixing device 12 is installed inside the apparatus body 100 and removed from the apparatus body 100. The guiding protrusion 50 is rectangular (e.g., a substantial oblong or a substantial square). The guiding protrusion 50 includes a slide face 50*a* serving as an upper plane and a slide face 50*b* serving as a lower plane. The slide faces 50*a* and 50*b* slide over the apparatus body guide. For example, according to this embodiment, when the fixing device 12 is installed into and removed from the apparatus body 100, a portion of the fixing device 12 other than the guiding protrusions 50 does not slide over the apparatus body 100 and therefore does not guide the fixing device 12, thus decreasing sliding friction between the fixing device 12 and the apparatus body 100 and improving usability. That is, only the guiding protrusions 50 slide over the apparatus body 100 when the fixing device 12 is installed into and removed from the apparatus body 100.

Figure 9:
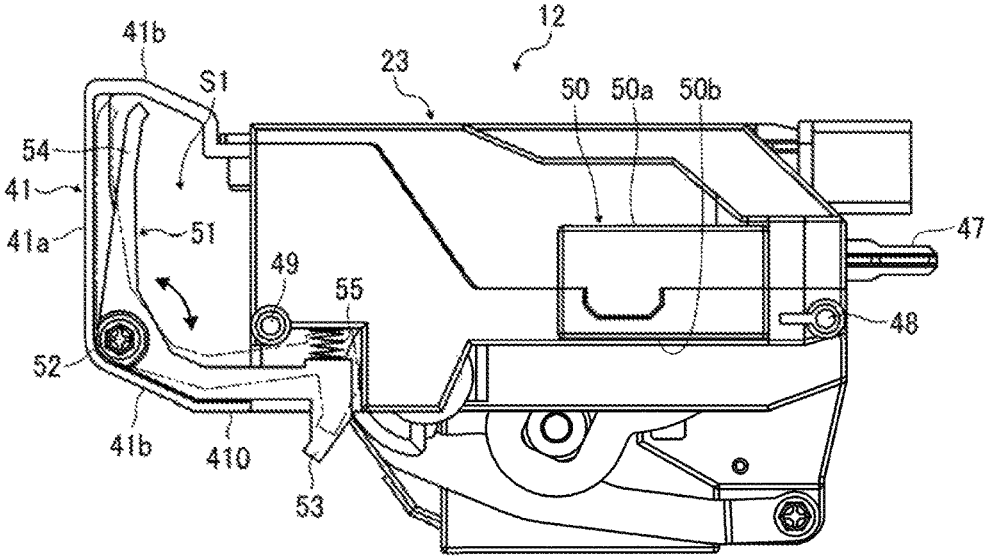
FIG. 9 is a left side view of the fixing device depicted in FIG. 2.

FIG. 9 is a left side view of the fixing device 12. As illustrated in FIG. 9, the fixing device 12 includes a lock 53 that secures the fixing device 12 to the apparatus body 100 to prevent the fixing device 12 installed inside the apparatus body 100 from separating from the apparatus body 100. The lock 53 is mounted on a part of a pivot member 51 pivotally mounted on the first grip 41. The pivot member 51 is substantially L-shaped. The pivot member 51 includes an arm extending forward or frontward from a fulcrum 52 about which the pivot member 51 pivots. The lock 53 is mounted on a tip of the arm of the pivot member 51. On the other hand, the pivot member 51 further includes a handle 54 extending upward from the fulcrum 52. The operator grips the handle 54 to pivot the pivot member 51.

A coil spring 55 serving as a biasing member is anchored to an upper face of the lock 53 and a lower face of the frame 23. The coil spring 55 biases the lock 53 downward constantly. Accordingly, while the operator does not pivot the pivot member 51, a lower portion of the pivot member 51 contacts a bottom 410 of the lower arm 41*b*. Consequently, the coil spring 55 retains the lock 53 such that a tip (e.g., a lower end) of the lock 53 projects beyond the bottom 410 of the lower arm 41*b* substantially downward as illustrated in FIG. 9 in a solid line. Thus, the lock 53 is in a lockable state in which the lock 53 is engageable with an engagement described below disposed inside the apparatus body 100.

Conversely, while the operator pivots the pivot member 51 counterclockwise in FIG. 9 against a bias exerted by the coil spring 55, the lock 53 is in an unlockable state in which the tip of the lock 53 retracts upward and does not engage the engagement disposed inside the apparatus body 100 as illustrated in FIG. 9 in an alternate long and two short dashes line. Accordingly, as the operator grips the handle 54 and pivots the pivot member 51, the pivot member 51 switches the lock 53 between the lockable state and the unlockable state. The pivot member 51 is similarly attached to the first grip 41 provided on a right side of the fixing device 12.

Figure 10:
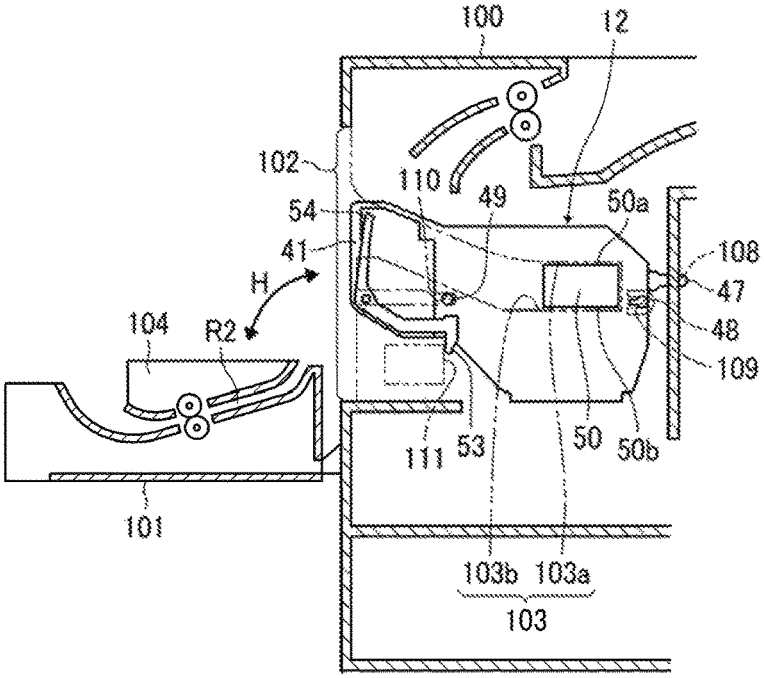
FIG. 10 is a schematic partial vertical cross-sectional view of an apparatus body of the image forming apparatus depicted in FIG. 1 installed with the fixing device.

FIG. 10 is a schematic partial vertical cross-sectional view of the apparatus body 100 installed with the fixing device 12. As illustrated in FIG. 10, a rear cover 101 that is openable is attached to a rear face, that is, a left face in FIG. 10, of the apparatus body 100. As the rear cover 101 pivots in a pivot direction H in FIG. 10, the rear cover 101 opens and closes with respect to the apparatus body 100. As illustrated in FIG. 10, when the rear cover 101 opens, an opening 102 is produced in the rear face of the apparatus body 100. The fixing device 12 is removed rearward from the apparatus body 100 through the opening 102. A method for attaching and detaching the fixing device 12 to and from the apparatus body 100 is described below in detail.

The rear cover 101 mounts a duplex conveyance unit 104 constructing a part of the duplex conveyance path R2. For example, the duplex conveyance unit 104 is molded with the rear cover 101. Accordingly, as illustrated in FIG. 10, when the rear cover 101 is opened, the duplex conveyance unit 104 pivots together with the rear cover 101. Thus, the duplex conveyance unit 104 retracts from a vicinity of a rear face of the fixing device 12.

A pair of guide rails 103 is mounted on an interior face of each of a left wall and a right wall of the apparatus body 100. The pair of guide rails 103 serves as an apparatus body guide that guides the fixing device 12 while the fixing device 12 is inserted into and removed from the apparatus body 100. Each of the guide rails 103 includes an upper guide face 103*a* and a lower guide face 103*b*. While the fixing device 12 is inserted into or removed from the apparatus body 100, the upper slide face 50*a* and the lower slide face 50*b* of the guiding protrusion 50 slide over the upper guide face 103*a* and the lower guide face 103*b* of the guide rail 103, respectively, thus guiding the fixing device 12.

Figure 11:
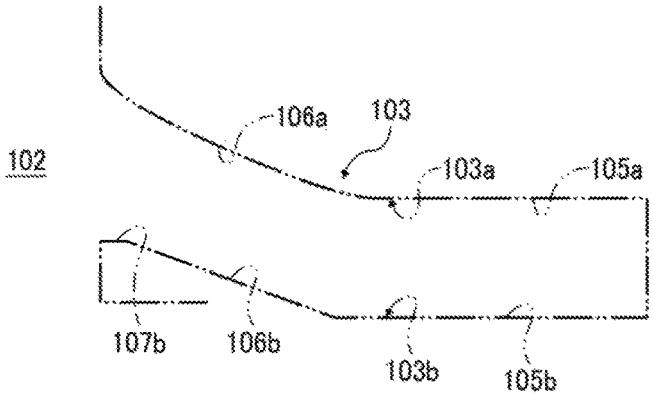
FIG. 11 is a side view of a guide rail incorporated in the apparatus body depicted in FIG. 10.

FIG. 11 is a side view of the guide rail 103. As illustrated in FIG. 11, the upper guide face 103*a* and the lower guide face 103*b* of the guide rail 103 include distal horizontal planes 105*a* and 105*b* and proximal slopes 106*a* and 106*b*, respectively. The distal horizontal planes 105*a* and 105*b* are distal from the opening 102 and extend substantially horizontally. The proximal slopes 106*a* and 106*b* extend obliquely upward from the distal horizontal planes 105*a* and 105*b* to the opening 102. The lower guide face 103*b* includes a proximal horizontal plane 107*b* that is interposed between the proximal slope 106*b* and the opening 102 and extends substantially horizontally.

As illustrated in FIG. 10, a plurality of apparatus body positioners, that is, a first apparatus body positioner 108, a second apparatus body positioner 109, and a third apparatus body positioner 110, is disposed inside the apparatus body 100. The apparatus body positioners position the fixing device 12 to the apparatus body 100. The first apparatus body positioner 108 engages the first positioning projection 47 disposed inside the fixing device 12 to position the fixing device 12 to the apparatus body 100 mainly horizontally. The second apparatus body positioner 109 engages the second positioning projection 48 disposed inside the fixing device 12 to position the fixing device 12 to the apparatus body 100 mainly frontward and vertically. The third apparatus body positioner 110 engages the third positioning projection 49 disposed inside the fixing device 12 to position the fixing device 12 to the apparatus body 100 in a pivot direction of the fixing device 12 that pivots about the second positioning projection 48.

As illustrated in FIG. 10, an engagement 111 that engages the lock 53 of the fixing device 12 is disposed inside the apparatus body 100. FIG. 10 illustrates the lock 53 engaging the engagement 111. The engagement 111 engaging the lock 53 positions the fixing device 12, restricting motion of the fixing device 12 rearward in a removal direction of the fixing device 12.

A description is provided of a method for removing the fixing device 12 from the apparatus body 100.

Figure 12:
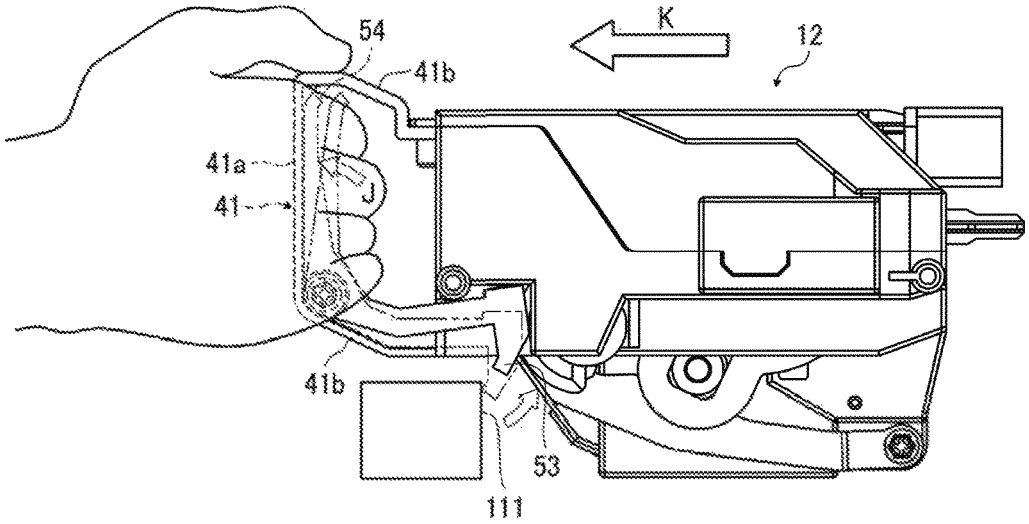
FIG. 12 is a side view of the fixing device depicted in FIG. 2, illustrating a first grip gripped by an operator.

In order to remove the fixing device 12 from the apparatus body 100, the operator opens the rear cover 101 as illustrated in FIG. 10. FIG. 12 is a side view of the fixing device 12, illustrating the first grip 41 gripped by the operator. As illustrated in FIG. 12, the operator approaches the first grips 41 of the fixing device 12 through the opening 102 of the apparatus body 100 and grips the first grips 41 with both hands, respectively. For example, the operator places his or her thumb on the upper arm 41*b* of the first grip 41 and grips the grip portion 41*a* and the handle 54 together with other fingers. As the operator pulls the handle 54 in a direction J and pivots the handle 54, engagement between the engagement 111 of the apparatus body 100 and the lock 53 of the fixing device 12 is released. While the lock 53 is in a lock release state (e.g., the unlockable state), the operator pulls and moves the fixing device 12 in a separation direction K.

Figure 13:
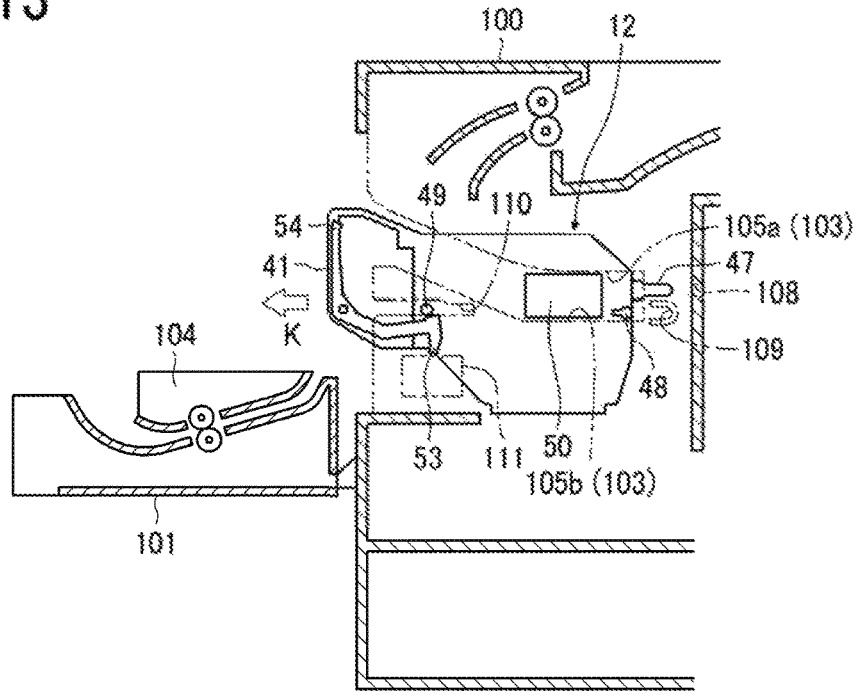
FIG. 13 is a schematic partial vertical cross-sectional view of the apparatus body depicted in FIG. 10, illustrating a process of removing the fixing device.

FIG. 13 is a schematic partial vertical cross-sectional view of the apparatus body 100, illustrating a process of removing the fixing device 12. As illustrated in FIG. 13, the fixing device 12 moves along the guide rails 103 of the apparatus body 100 leftward in FIG. 13 in the separation direction K. As illustrated in FIG. 10, the first positioning projection 47, the second positioning projection 48, and the third positioning projection 49 of the fixing device 12 separate from the first apparatus body positioner 108, the second apparatus body positioner 109, and the third apparatus body positioner 110 of the apparatus body 100. As illustrated in FIG. 13, when the operator starts moving the fixing device 12, the guiding protrusion 50 of the fixing device 12 slides over the distal horizontal planes 105*a* and 105*b* of the guide rail 103, moving the fixing device 12 substantially horizontally.

Figure 14:
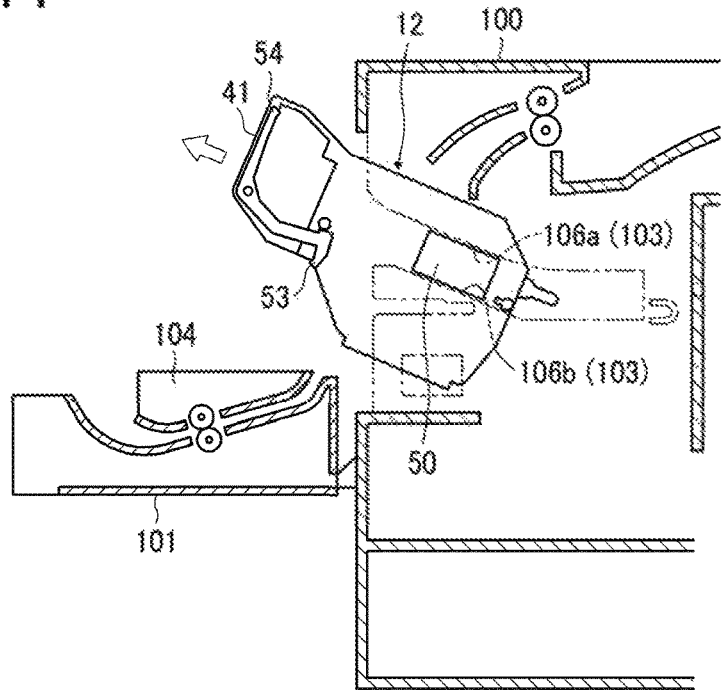
FIG. 14 is a schematic partial vertical cross-sectional view of the apparatus body depicted in FIG. 10, illustrating another process of removing the fixing device.

FIG. 14 is a schematic partial vertical cross-sectional view of the apparatus body 100, illustrating another process of removing the fixing device 12. As illustrated in FIG. 14, as the guiding protrusion 50 slides over the proximal slopes 106*a* and 106*b* of the guide rail 103, the fixing device 12 moves obliquely upward.

Figure 15:
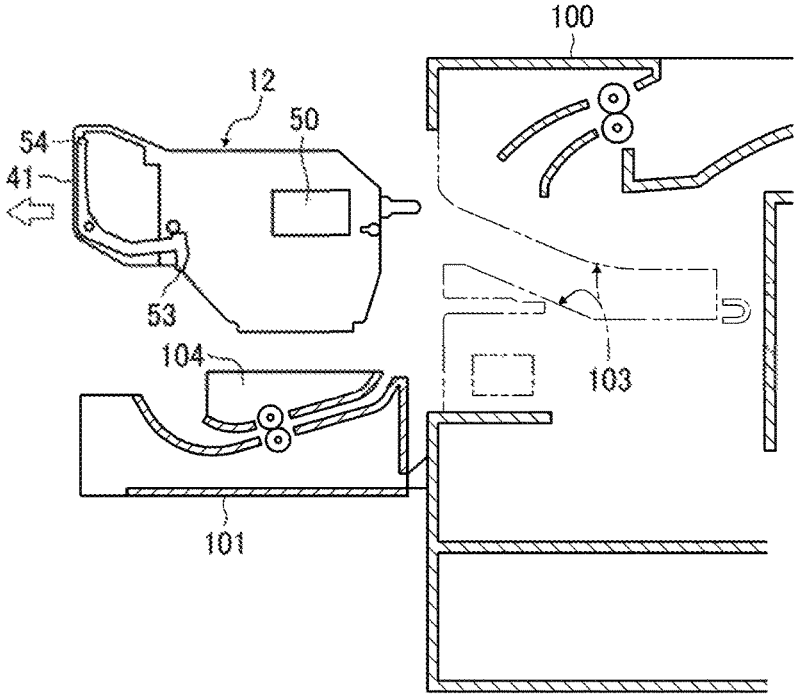
FIG. 15 is a schematic partial vertical cross-sectional view of the apparatus body depicted in FIG. 10, illustrating yet another process of removing the fixing device.

FIG. 15 is a schematic partial vertical cross-sectional view of the apparatus body 100, illustrating yet another process of removing the fixing device 12. Thereafter, as illustrated in FIG. 15, the operator pulls the fixing device 12 out of the apparatus body 100 and removes the fixing device 12 from the apparatus body 100.

According to this embodiment, the guide rail 103 guides the fixing device 12 obliquely upward while preventing the fixing device 12 from coming into contact with the duplex conveyance unit 104 so that the fixing device 12 is removed from the apparatus body 100. If the fixing device 12 is configured to be guided horizontally, in order to prevent the fixing device 12 from coming into contact with the duplex conveyance unit 104, the fixing device 12 may be situated at a higher position inside the apparatus body 100 and an upper edge of the rear face of the apparatus body 100, which defines the opening 102, may be situated at a higher position, increasing the height of the apparatus body 100. Conversely, according to this embodiment, even if the fixing device 12 and the opening 102 are not situated at the higher positions, respectively, the guide rail 103 prevents the fixing device 12 from coming into contact with the duplex conveyance unit 104, thus decreasing the height of the apparatus body 100 and downsizing the apparatus body 100.

Figure 16:
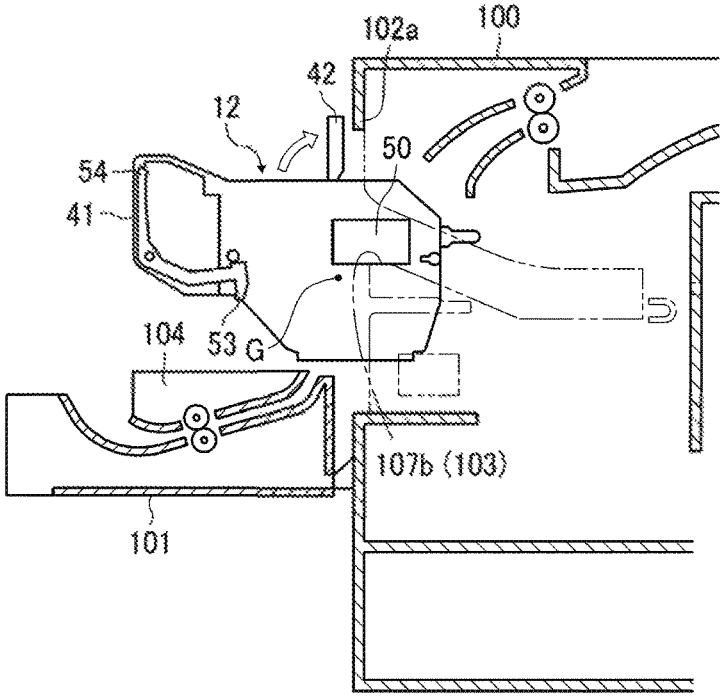
FIG. 16 is a schematic partial vertical cross-sectional view of the apparatus body depicted in FIG. 10, illustrating a second grip of the fixing device.

While the operator pulls the fixing device 12 out of the apparatus body 100 as described above, the operator may use the second grip 42. FIG. 16 is a schematic partial vertical cross-sectional view of the apparatus body 100, illustrating the second grip 42 of the fixing device 12. As illustrated in FIG. 16, while the guiding protrusion 50 is placed on the proximal horizontal plane 107*b* of the guide rail 103, the operator lifts the second grip 42 from the storage position to the usage position. When the operator moves the second grip 42 from the storage position to the usage position, the operator holds the fixing device 12 with his or her hand temporarily. To address this circumstance, the fixing device 12 is placed on the proximal horizontal plane 107*b* of the guide rail 103, decreasing a load imposed on one hand of the operator that grips the first grip 41. Accordingly, while retaining the fixing device 12 stably, the operator moves the second grip 42.

Additionally, according to this embodiment, the guiding protrusion 50 is situated in proximity to a center of gravity G of the fixing device 12 when seen in a width direction, that is, a longitudinal direction, of the fixing device 12 from a left side or the right side of the fixing device 12. Accordingly, the guide rail 103 supports the fixing device 12 stably.

Additionally, since the guiding protrusion 50 is situated in proximity to the center of gravity G of the fixing device 12, the fixing device 12 moves along the guide rail 103 stably, facilitating installation and removal of the fixing device 12.

As the operator lifts the second grip 42 to the usage position as described above, the operator switches from the first grip 41 to the second grip 42 to remove the fixing device 12. Since the second grip 42 is disposed closer to the center of gravity G of the fixing device 12 than the first grip 41 is as illustrated in FIG. 16, a force acted on the hand of the user in a gravitational direction when the operator grips the second grip 42 is smaller than that when the operator grips the first grip 41. Accordingly, the operator holds the fixing device 12 with the second grip 42 while the hand receives less load. Hence, the operator removes the fixing device 12 from the apparatus body 100, carries the fixing device 12, and puts the fixing device 12 into a packing carton readily.

A description is provided of a method for installing the fixing device 12 into the apparatus body 100.

The fixing device 12 is installed into the apparatus body 100 in processes opposite the processes for removing the fixing device 12 from the apparatus body 100 described above. While gripping the first grip 41 and the handle 54, the operator inserts the fixing device 12 into the apparatus body 100 along the guide rail 103. When the first positioning projection 47, the second positioning projection 48, and the third positioning projection 49 depicted in FIG. 10 engage the first apparatus body positioner 108, the second apparatus body positioner 109, and the third apparatus body positioner 110, respectively, the operator grips the first grip 41 and the handle 54 loosely. Accordingly, a bias of the coil spring 55 causes the lock 53 to engage the engagement 111 of the apparatus body 100, thus locking the fixing device 12. According to this embodiment, when a driving force is transmitted to the fixing device 12, a force acts in an installation direction of the fixing device 12 between the driving gear disposed inside the apparatus body 100 and the fixing gear 18G mounted on one lateral end of the fixing roller 18 in the axial direction. Thus, the fixing device 12 is positioned inside the apparatus body 100 precisely.

The operator may use the second grip 42 also when installing the fixing device 12 into the apparatus body 100. However, since the operator does not finish installation of the fixing device 12 while gripping the second grip 42, the operator switches from the second grip 42 to the first grip 41 during installation of the fixing device 12. To address this circumstance, as illustrated in FIG. 16, while the guiding protrusion 50 is placed on the proximal horizontal plane 107*b* of the guide rail 103, the operator lowers the second grip 42 from the usage position to the storage position, thus reducing a load imposed on the hand of the operator. Even if the operator forgets moving the second grip 42 to the storage position, the second grip 42 switches to the storage position automatically. According to this embodiment, since the second grip 42 lies down leftward in FIG. 16 in a direction opposite the installation direction of the fixing device 12, even if the second grip 42 is at the usage position, when the second grip 42 comes into contact with an opening edge 102*a* of the apparatus body 100 that defines the opening 102, the second grip 42 lies down smoothly to the storage position. Thus, the operator installs the fixing device 12 into the apparatus body 100 without damaging the second grip 42 and the apparatus body 100.

Since the second grip 42 lies down in the direction opposite the installation direction of the fixing device 12 and moves to the storage position, when the operator removes the fixing device 12 from the apparatus body 100, the operator lifts the second grip 42 readily to the usage position. For example, since the grip portion 42*a* of the second grip 42 at the storage position depicted in FIG. 5 is situated in proximity to the operator, the operator lifts the second grip 42 to the usage position readily without inserting his or her hand deep inside the apparatus body 100.

Figure 17:
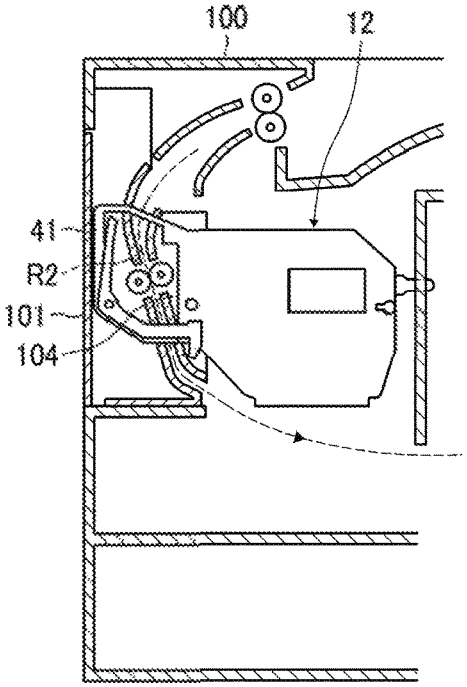
FIG. 17 is a schematic partial vertical cross-sectional view of the apparatus body depicted in FIG. 10, illustrating a rear cover that is closed.

FIG. 17 is a schematic partial vertical cross-sectional view of the apparatus body 100, illustrating the rear cover 101 that is closed. As illustrated in FIG. 17, according to this embodiment, when the rear cover 101 is closed, the duplex conveyance unit 104 is interposed between the first grips 41. The duplex conveyance unit 104 interposed between the first grips 41 spares a space between the first grips 41 as a part of the duplex conveyance path R2 effectively, downsizing the apparatus body 100 further. Additionally, according to this embodiment, as illustrated in FIG. 7, a plurality of ribs 56 is mounted on the lower face of the frame 23 of the fixing device 12. The ribs 56 allow the lower face of the frame 23 to also serve as a conveyance guide that guides a sheet P conveyed through the duplex conveyance path R2.

The pair of guiding protrusions 50 of the fixing device 12 facilitates installation and removal of the fixing device 12 as described above. However, the length of the fixing device 12 in the longitudinal direction thereof may increase.

For example, a comparative fixing device that is detachably attached to an apparatus body of an image forming apparatus includes a guiding protrusion that moves along a rail disposed inside the apparatus body, thus facilitating attachment and detachment of the comparative fixing device with respect to the apparatus body.

However, if an outer cover of the comparative fixing device protrudes outward to create the guiding protrusion, the length of the comparative fixing device may increase, upsizing the comparative fixing device.

To address this circumstance, the fixing device 12 according to the embodiments described above has a configuration to suppress increase in the length of the fixing device 12 in the longitudinal direction thereof as described below.

Figure 18:
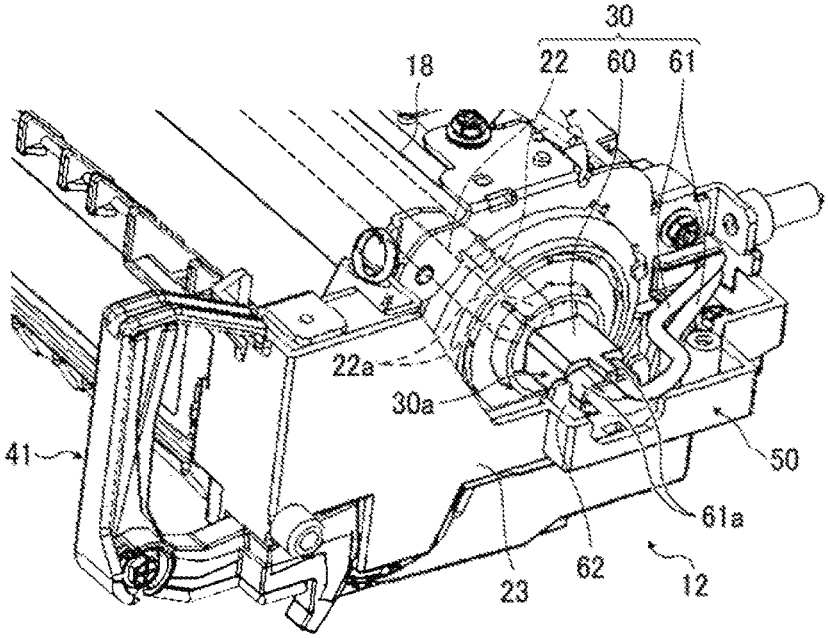
FIG. 18 is a perspective view of the fixing device depicted in FIG. 2 from which the upper portion of the exterior of the fixing device is removed, illustrating a guiding protrusion of the fixing device.

FIG. 18 is a perspective view of the fixing device 12 from which the upper portion of the exterior of the fixing device 12 is removed. FIG. 18 illustrates one lateral end of the fixing device 12 in the longitudinal direction thereof.

According to this embodiment, the halogen heater 22 is used as a heat generator. As illustrated in FIG. 18, a feeder 61 (e.g., an electric supply line) is coupled to a lateral end 22*a* of the halogen heater 22 in a longitudinal direction thereof parallel to the axial direction of the fixing roller 18. The feeder 61 supplies power from the power supply disposed inside the apparatus body 100 to the halogen heater 22. Abase 60 is insulative and made of ceramics or the like. The base 60 is attached to the lateral end 22*a* of the halogen heater 22 in the longitudinal direction thereof. A heater 30 constructed of the halogen heater 22, the base 60, and the feeder 61 occupies an elongate space in the longitudinal direction of the fixing device 12 compared to other components of the fixing device 12. A lateral end 30*a* of the heater 30 may project beyond a lateral end of other components of the fixing device 12 in the longitudinal direction thereof. The lateral end 30*a* of the heater 30 denotes a component or a part of the component of the heater 30 that is disposed at a lateral end of the fixing device 12 in the longitudinal direction thereof. For example, according to this embodiment, the lateral end 30*a* of the heater 30 includes the lateral end 22*a* of the halogen heater 22, the base 60 attached to the halogen heater 22, and a lateral end 61*a* of the feeder 61 coupled to the halogen heater 22.

Like the lateral end 30*a* of the heater 30, the guiding protrusion 50 also projects beyond the lateral end of other components of the fixing device 12 in the longitudinal direction thereof. Hence, as illustrated in FIG. 18, the lateral end 30*a* of the heater 30 is disposed inside or housed by the guiding protrusion 50 partially or entirely. For example, the lateral end 30*a* of the heater 30 and the guiding protrusion 50 that project beyond the lateral end of other components of the fixing device 12 in the longitudinal direction thereof are disposed opposite each other, thus utilizing an interior space of the guiding protrusion 50. The components of the fixing device 12 other than the guiding protrusion 50 have a length smaller than a length of the guiding protrusion 50 in the longitudinal direction of the fixing device 12. According to this embodiment, as illustrated in FIG. 3, the frame 23 includes the guiding protrusion 50 and a body 23*c* that is other than the guiding protrusion 50. The body 23*c* has a length W1 smaller than a length W2 of the heater 30 in the longitudinal direction of the fixing device 12, thus suppressing increase in the length of the fixing device 12 in the longitudinal direction thereof and downsizing the fixing device 12.

A description is provided of variations of the guiding protrusion 50.

Figure 19A:
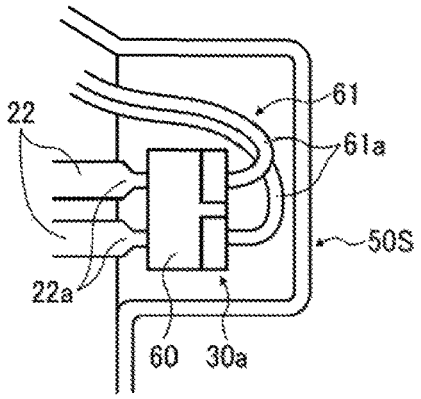
FIG. 19A is a plan view of a guiding protrusion as a first variation of the guiding protrusion depicted in FIG. 18.

FIG. 19A is a plan view of a guiding protrusion SOS as a first variation of the guiding protrusion 50. As illustrated in FIG. 19A, the guiding protrusion SOS houses the lateral end 22*a* of the halogen heater 22 in the longitudinal direction thereof, the base 60 attached to the halogen heater 22, and the lateral end 61*a* of the feeder 61 coupled to the halogen heater 22.

Figure 19B:
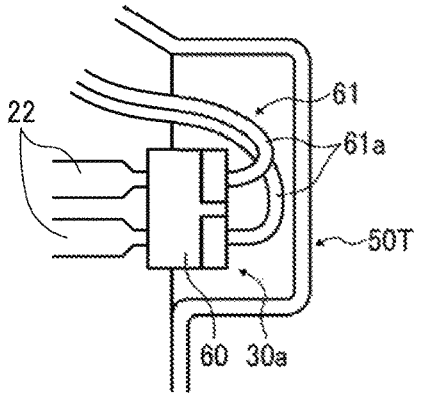
FIG. 19B is a plan view of a guiding protrusion as a second variation of the guiding protrusion depicted in FIG. 18.

FIG. 19B is a plan view of a guiding protrusion SOT as a second variation of the guiding protrusion 50. As illustrated in FIG. 19B, the guiding protrusion SOT houses the base 60 attached to the halogen heater 22 and the lateral end 61*a* of the feeder 61 coupled to the halogen heater 22.

Figure 19C:
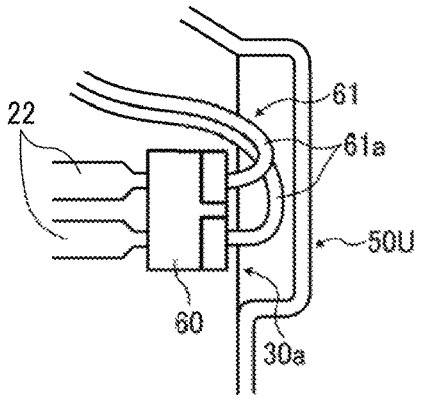
FIG. 19C is a plan view of a guiding protrusion as a third variation of the guiding protrusion depicted in FIG. 18.

FIG. 19C is a plan view of a guiding protrusion 50U as a third variation of the guiding protrusion 50. As illustrated in FIG. 19C, the guiding protrusion 50U houses the lateral end 61*a* of the feeder 61 coupled to the halogen heater 22.

At another lateral end 22*a* of the halogen heater 22 in the longitudinal direction thereof, that is not coupled to the feeder 61, the guiding protrusion 50 may house the another lateral end 22*a* of the halogen heater 22 and the base 60 or may house the base 60. Alternatively, the guiding protrusion 50 may house one lateral end 30*a* of the heater 30 instead of both lateral ends 30*a* of the heater 30 in the longitudinal direction thereof. In either case, the guiding protrusion 50 suppresses increase in the length of the fixing device 12 in the longitudinal direction thereof.

Figure 20:
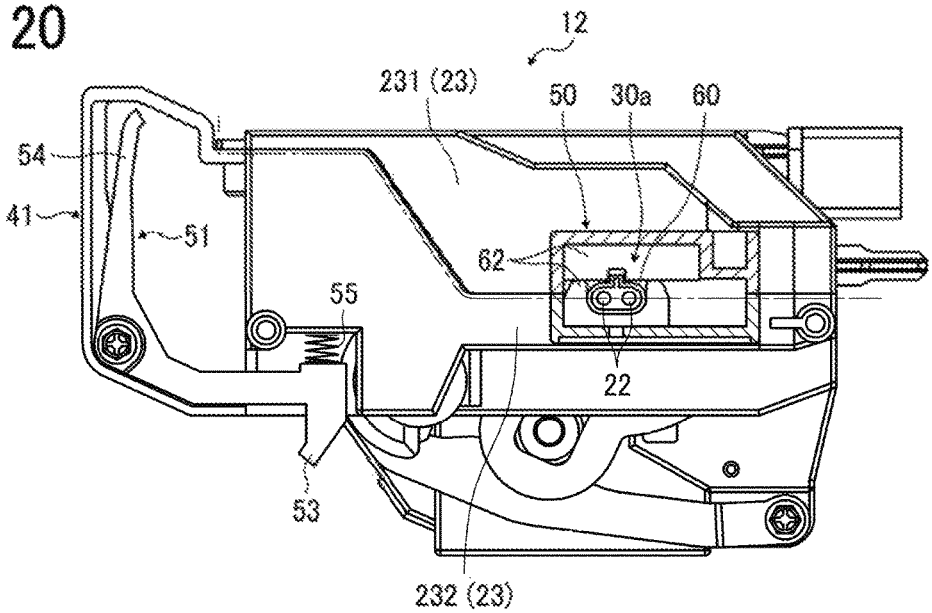
FIG. 20 is a vertical cross-sectional view of the fixing device depicted in FIG. 12 taken on the guiding protrusion.

FIG. 20 is a vertical cross-sectional view of the fixing device 12 taken on the guiding protrusion 50. As illustrated in FIG. 20, according to this embodiment, a holding rib 62 is mounted on the frame 23. The holding rib 62 serves as a heater holder that holds the lateral end 30*a* of the heater 30. The frame 23 is divided, at a boundary indicated by an alternate long and short dash line in FIG. 20 passing through the guiding protrusion 50, into an upper portion 231 serving as a first divided portion and a lower portion 232 serving as a second divided portion separable from the upper portion 231. Each of the upper portion 231 and the lower portion 232 mounts the holding rib 62. As the upper portion 231 is combined with the lower portion 232, the holding rib 62 mounted on the upper portion 231 and the holding rib 62 mounted on the lower portion 232 sandwich the base 60, thus retaining the halogen heater 22 at a predetermined position. Since the upper portion 231 is separable from the lower portion 232 at the boundary passing through the guiding protrusion 50, the operator installs the lateral end 30*a* of the heater 30 inside the guiding protrusion 50 readily.

Figure 21:
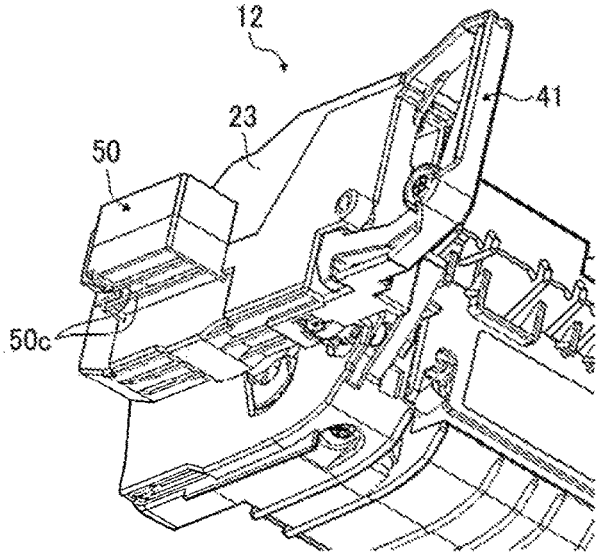
FIG. 21 is a perspective view of the fixing device depicted in FIG. 20, viewing the guiding protrusion from a position obliquely downward from the fixing device.

FIG. 21 is a perspective view of the fixing device 12, viewing the guiding protrusion 50 from a position obliquely downward from the fixing device 12. Since the fixing device 12 according to this embodiment includes the first grip 41 and the second grip 42, the operator usually grips the first grip 41 and the second grip 42 to attach the fixing device 12 to the apparatus body 100 and detach the fixing device 12 from the apparatus body 100. Alternatively, the operator may grip the guiding protrusion 50. However, since the guiding protrusion 50 houses the lateral end 30*a* of the heater 30, the guiding protrusion 50 is susceptible heat from the lateral end 30*a* of the heater 30.

To address this circumstance, in view of safety, as illustrated in FIG. 21, a plurality of projections 50*c* is mounted on an outer face (e.g., a lower face) of the guiding protrusion 50. Accordingly, even if the finger of the operator touches the lower face of the guiding protrusion 50, the projections 50*c* decrease a contact area where the finger of the operator touches the lower face of the guiding protrusion 50, rendering the operator to be less susceptible to heat. Alternatively, in addition to the lower face of the guiding protrusion 50, the projections 50*c* may be mounted on other exterior faces (e.g., an upper face and side faces) of the guiding protrusion 50. Yet alternatively, the guiding protrusion 50 may mount recesses instead of the projections 50*c*.

The present disclosure is not limited to the details of the embodiments described above and various modifications and improvements are possible. FIG. 2 illustrates the halogen heater 22 used as a heater that heats the fixing roller 18. Alternatively, other heaters may be used. For example, the fixing device 12 may employ, as the heater, an induction heater (IH) using an electromagnetic induction heating method, a resistive heat generator, a carbon heater, or the like. Yet alternatively, the heater may heat the pressure roller 19 serving as an opposed rotator disposed opposite the fixing roller 18. In this case also, like in the embodiments described above, a lateral end of the heater in a longitudinal direction thereof is disposed inside the guiding protrusion 50, suppressing increase in the length of the fixing device 12 in the longitudinal direction thereof.

The fixing device 12 according to the embodiments described above employs the fixing roller 18 as a fixing rotator. Alternatively, the embodiments described above are applicable to a fixing device that does not incorporate the fixing roller 18 as illustrated in FIG. 22, for example.

Figure 22:
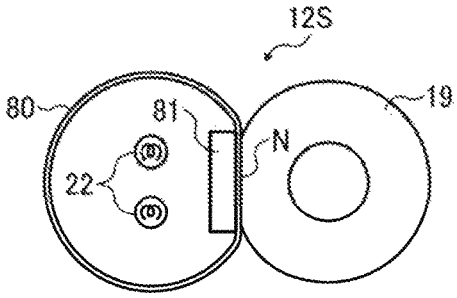
FIG. 22 is a vertical cross-sectional view of another fixing device installable in the image forming apparatus depicted in FIG. 1.

FIG. 22 is a vertical cross-sectional view of a fixing device 12S. As illustrated in FIG. 22, the fixing device 12S (e.g., a fuser or a fusing unit) includes a fixing belt 80 that is endless and serves as a fixing rotator. The pressure roller 19 is pressed against a nip formation pad 81, disposed inside a loop formed by the fixing belt 80, via the fixing belt 80 to form the fixing nip N between the fixing belt 80 and the pressure roller 19.

According to the embodiments described above, the fixing device 12 is installed into the apparatus body 100 and removed from the apparatus body 100 through the rear face of the apparatus body 100. Alternatively, the fixing device 12 may be installed into the apparatus body 100 and removed from the apparatus body 100 through any one of a front face, a right side face, and a left side face of the apparatus body 100.

A description is provided of advantages of the fixing devices 12 and 12S.

As illustrated in FIG. 18, a fixing device (e.g., the fixing devices 12 and 12S) includes a heater (e.g., the heater 30) and a convex guide (e.g., the guiding protrusion 50). The heater heats a recording medium (e.g., a sheet P) to fix a toner image on the recording medium. As illustrated in FIG. 10, the convex guide is guided along an apparatus guide (e.g., the guide rail 103) disposed inside an apparatus body (e.g., the apparatus body 100) as the fixing device is installed into and removed from the apparatus body. As illustrated in FIG. 18, the heater includes a lateral end (e.g., the lateral end 30*a*) in a longitudinal direction of the heater, which is disposed inside the convex guide.

Accordingly, the lateral end of the heater, which is disposed inside the convex guide, utilizes a space inside the convex guide, suppressing increase in the length of the fixing device in a longitudinal direction thereof and downsizing the fixing device.

According to the embodiments described above, the fixing roller 18 serves as a fixing rotator. Alternatively, a fixing belt (e.g., a fixing sleeve), a fixing film, or the like may be used as a fixing rotator. Further, the pressure roller 19 serves as an opposed rotator. Alternatively, a pressure belt or the like may be used as an opposed rotator.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present invention.

Any one of the above-described operations may be performed in various other ways, for example, in an order different from the one described above.

What is claimed is:

1. A fixing device removably installed inside an apparatus body including an apparatus guide, the fixing device comprising:

a convex guide guided along the apparatus guide; and a heater to heat a recording medium to fix a toner image on the recording medium, the heater including a lateral end in a longitudinal direction of the heater, the lateral end disposed inside the convex guide.

2. The fixing device according to claim 1, further comprising a fixing rotator to come into contact with the recording medium, wherein the heater further includes:

a heat generator to heat the fixing rotator, the heat generator including a lateral end in a longitudinal direction of the heat generator;

a base attached to the lateral end of the heat generator; and a feeder to supply power to the heat generator, the feeder including a lateral end coupled to the lateral end of the heat generator and disposed inside the convex guide.

3. The fixing device according to claim 2, wherein the base is disposed inside the convex guide.

4. The fixing device according to claim 3, wherein the lateral end of the heat generator is disposed inside the convex guide.

5. The fixing device according to claim 2, wherein the heat generator includes a halogen heater.

6. The fixing device according to claim 1, further comprising an exterior including:

a first divided portion; and a second divided portion being divided at the convex guide and separable from the first divided portion.

7. The fixing device according to claim 6, further comprising a heater holder mounted on each of the first divided portion and the second divided portion, the heater holder to sandwich the lateral end of the heater when the first divided portion is combined with the second divided portion.

8. The fixing device according to claim 7, wherein the heater holder includes a rib.

9. The fixing device according to claim 1, further comprising a plurality of projections mounted on an outer face of the convex guide.

10. The fixing device according to claim 1, further comprising a plurality of recesses mounted on an outer face of the convex guide.

11. The fixing device according to claim 1, wherein the convex guide is situated in proximity to a center of gravity of the fixing device when seen in a longitudinal direction of the fixing device.

12. The fixing device according to claim 1, wherein the convex guide slides over the apparatus body when the fixing device is installed into and removed from the apparatus body.

13. An image forming apparatus comprising:

an apparatus body including an apparatus guide; and a fixing device removably installed inside the apparatus body, the fixing device including:

a convex guide guided along the apparatus guide; and a heater to heat a recording medium to fix a toner image on the recording medium, the heater including a lateral end in a longitudinal direction of the heater, the lateral end disposed inside the convex guide.

14. The image forming apparatus according to claim 13, wherein the apparatus guide includes a guide rail over which the convex guide of the fixing device slides.

* * * * *